US011740577B2

(12) United States Patent
Miyashita

(10) Patent No.: US 11,740,577 B2
(45) Date of Patent: Aug. 29, 2023

(54) IMAGE FORMING APPARATUS WITH HEATING DEVICE

(71) Applicant: TOSHIBA TEC KABUSHIKI KAISHA, Tokyo (JP)

(72) Inventor: Kousei Miyashita, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/945,017

(22) Filed: Sep. 14, 2022

(65) Prior Publication Data

US 2023/0004109 A1 Jan. 5, 2023

Related U.S. Application Data

(63) Continuation of application No. 17/336,800, filed on Jun. 2, 2021, now abandoned.

(30) Foreign Application Priority Data

Dec. 14, 2020 (JP) ..... 2020-206648

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01)

(58) Field of Classification Search
USPC ..... 399/328
See application file for complete search history.

(56) References Cited

U.S. PATENT DOCUMENTS

| | | | |
|---|---|---|---|
| 10,859,952 | B2 | 12/2020 | Takagi |
| 10,928,755 | B2 | 2/2021 | Kikuchi |
| 2009/0230114 | A1 | 9/2009 | Taniguchi et al. |
| 2012/0308280 | A1 | 12/2012 | Tsuruya et al. |
| 2014/0270824 | A1 | 9/2014 | Satoh et al. |

(Continued)

FOREIGN PATENT DOCUMENTS

| | | | |
|---|---|---|---|
| EP | 3260925 | A1 | 12/2017 |
| EP | 3693804 | A1 | 8/2020 |
| JP | 2001043956 | A | 2/2001 |

(Continued)

OTHER PUBLICATIONS

Extended European Search Report dated Dec. 23, 2021, mailed in counterpart European Application No. 21184285.1, 9 pages.

*Primary Examiner* — Quana Grainger
(74) *Attorney, Agent, or Firm* — Kim & Stewart LLP

(57) ABSTRACT

An image forming apparatus includes an image forming unit to form an image on a sheet. A fixing device heats the sheet and includes a tubular body that presses against the sheet and rotates, and a heat generator contacts an inside surface of the tubular body. The length dimension of the heat generator is aligned with the axial direction of the tubular body. The heat generator has a first row of first heating elements with a first gap between each adjacent pair of first heating elements and a second row of second heating elements. The first and second rows are offset from one another in a width direction corresponding to the sheet conveyance direction. A second gap is between each adjacent pair of second heating elements in the longitudinal direction. The positions of the first gaps are different from positions of the second gaps.

20 Claims, 7 Drawing Sheets

(56) References Cited

U.S. PATENT DOCUMENTS

| | | | | |
|---|---|---|---|---|
| 2017/0075266 | A1 | 3/2017 | Mochizuki et al. | |
| 2021/0255569 | A1* | 8/2021 | Uekawa | G03G 15/2039 |

FOREIGN PATENT DOCUMENTS

| | | | |
|---|---|---|---|
| JP | 2016001223 | A | 1/2016 |
| JP | 2016031785 | A | 3/2016 |
| JP | 2016164826 | A | 9/2016 |
| WO | 2017090692 | A1 | 11/2017 |

* cited by examiner

IMAGE FORMING APPARATUS WITH HEATING DEVICE

CROSS-REFERENCE TO RELATED APPLICATIONS

This application is a continuation of U.S. patent application Ser. No. 17/336,800, filed on Jun. 2, 2021, which is based upon and claims the benefit of priority from Japanese Patent Application No. 2020-206648, filed Dec. 14, 2020, the entire contents of each of which are incorporated herein by reference.

FIELD

Embodiments described herein generally relate to an image forming apparatus.

BACKGROUND

An image forming apparatus that forms an image on a sheet of paper or the like may include a fixing device that fixes a toner to the sheet with heating. It is desirable for such an image forming apparatus to have a fixing device without heating variations across the sheet during printing operations.

DETAILED DESCRIPTION

In general, according to one embodiment, an image forming apparatus includes an image forming unit that is configured to form an image on a sheet, and a fixing device that is configured to heat the sheet. The fixing device includes a tubular body configured to press against the sheet and rotate in a sheet conveyance direction. A heat generator in the fixing device has a first surface that contacts an inner surface of the tubular body. A longitudinal direction of the heat generator is aligned with an axial direction of the tubular body. The heat generator includes a plurality of first heating elements in a first row along the longitudinal direction. A first gap is between each adjacent pair of first heating elements in the longitudinal direction. The heat generator also includes a plurality of second heating elements in a second row along the longitudinal direction. The first and second rows are offset from one another in a width direction corresponding to the sheet conveyance direction. A second gap is between each adjacent pair of second heating elements in the longitudinal direction. The positions of the first gaps along the longitudinal direction are different from positions of the second gaps along the longitudinal direction.

Some example embodiments of an image forming apparatus will be described with reference to the accompanying drawings.

Figure 1:
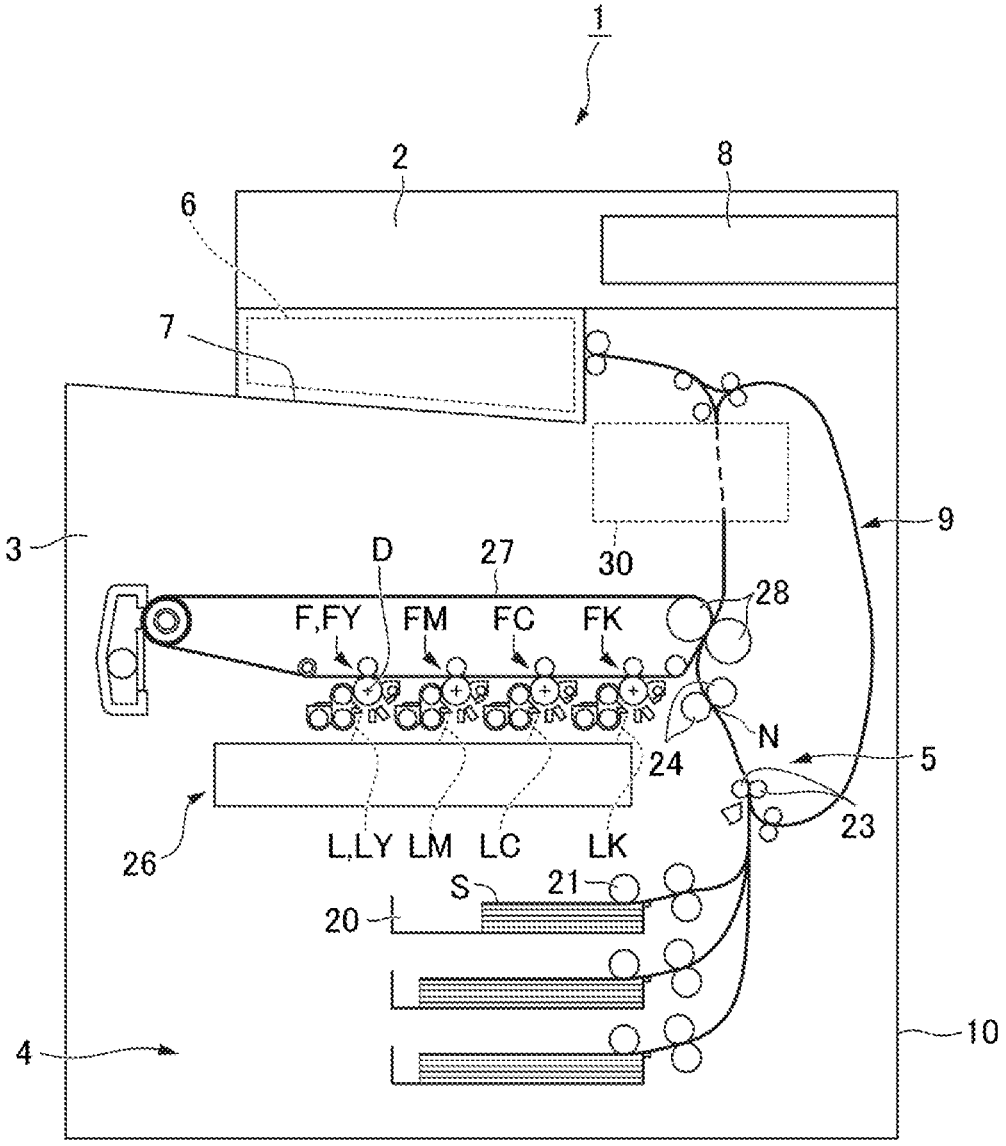
FIG. 1 depicts an image forming apparatus according to an embodiment.

FIG. 1 depicts an example schematic configuration of an image forming apparatus 1 according to one embodiment. The image forming apparatus 1 performs a process of forming an image on a sheet S. The sheet S may be paper. The image forming apparatus 1 includes a housing 10, a scanner unit 2, an image forming unit 3, a sheet conveyance unit 4 (also referred to as a sheet conveyor 4), a conveyance unit 5, a tray 7, and a reversing unit 9 as well as a control panel 8 and a control unit 6 (also referred to as a controller 6).

The housing 10 forms an outer shape of the image forming apparatus 1. The scanner unit 2 reads image information of an object to be copied as brightness and darkness of reflected light or the like and generates an image signal. The scanner unit 2 outputs the generated image signal to the image forming unit 3. The image forming unit 3 forms a toner image based on the image signal from the scanner unit 2. The image signal to be used for forming the toner image may be provided by an external device. The toner image is an image formed of toner or other material. The image forming unit 3 transfers the toner image onto a surface of the sheet S. The image forming unit 3 heats and presses the toner image on the surface of the sheet S to fix the toner image on the sheet S.

The sheet supply unit 4 supplies the sheet S to the conveyance unit 5 in accordance with the timing of forming the toner image by the image forming unit 3. The sheet supply unit 4 includes one or more sheet storage units 20 and one or more pickup rollers 21 for the respective sheet storage units. The sheet storage unit 20 stores a plurality of sheets S of one or more sizes and types. Each pickup roller 21 takes out one sheet S at a time from the corresponding sheet storage unit 20 and supplies it to the conveyance unit 5.

The conveyance unit 5 conveys the sheet S from the sheet supply unit 4 to the image forming unit 3 in a conveyance direction. The conveyance unit 5 includes conveyance rollers 23 and registration rollers 24. The conveyance rollers 23 convey the sheet S from the pickup roller 21 of the sheet storage unit 20 to the registration rollers 24. The conveyance rollers 23 position a front end of the sheet S in the conveyance direction against a registration nip N, which is a nip between the pair of registration rollers 24. The registration rollers 24 adjust a position of the leading edge (tip) of the sheet S along the conveyance direction by holding the sheet S at the registration nip N. The registration rollers 24 convey the sheet S in accordance with the timing at which the image forming unit 3 can transfer the toner image onto the sheet S.

The image forming unit 3 includes a plurality of image forming units F (FY, FM, FC, FK), a laser scanner 26, an intermediate transfer belt 27, a transfer device 28, and a fixing device 30. Each image forming unit F includes a photosensitive drum D. Each image forming unit F forms a toner image corresponding to the image signal on the photosensitive drum D. The image forming units FY, FM, FC, FK form toner images with yellow, magenta, cyan, and black toners, respectively.

The electrostatic charger charges the surface of a photosensitive drum D. Each developing device contains a developer with one yellow, magenta, cyan, and black toners. The developing device supplies toner/developer to develop the electrostatic latent image on the photosensitive drum D to form a toner image on the photosensitive drum D.

The laser scanner 26 scans the charged photosensitive drums D with laser light L (LY, LM, LC, LK) to expose the respective photosensitive drums D. The laser scanning unit 26 uses the laser light LY, LM, LC, LK to form the electrostatic latent images on the photosensitive drums D of the image forming units FY, FM, FC, and FK of the respective colors.

The toner image on the surface of each photosensitive drum D is primarily transferred to the intermediate transfer belt 27. The transfer device 28 transfers the toner image from the intermediate transfer belt 27 onto the surface of the sheet S at a secondary transfer position. The fixing device 30 fixes the toner image onto the sheet S by heating and pressing the tonner image.

The reversing unit 9 reverses the sheet S in order to form an image on a back surface of the sheet S when duplex printing is requested. The reversing unit 9 reverses the sheet S discharged from the fixing device 30 by a switchback or the like. The reversing unit 9 conveys the reversed sheet S back to the registration rollers 24.

After all image forming processes are complete, the sheet S on which an image has been formed is discharged onto the tray 7.

The control panel 8 is an example of an input unit through which an operator or a user of the image forming apparatus 1 enters instructions, commands, information, or the like for operating the image forming apparatus 1. The control panel 8 includes a touch panel and various keys, buttons, and/or switches.

Figure 2:
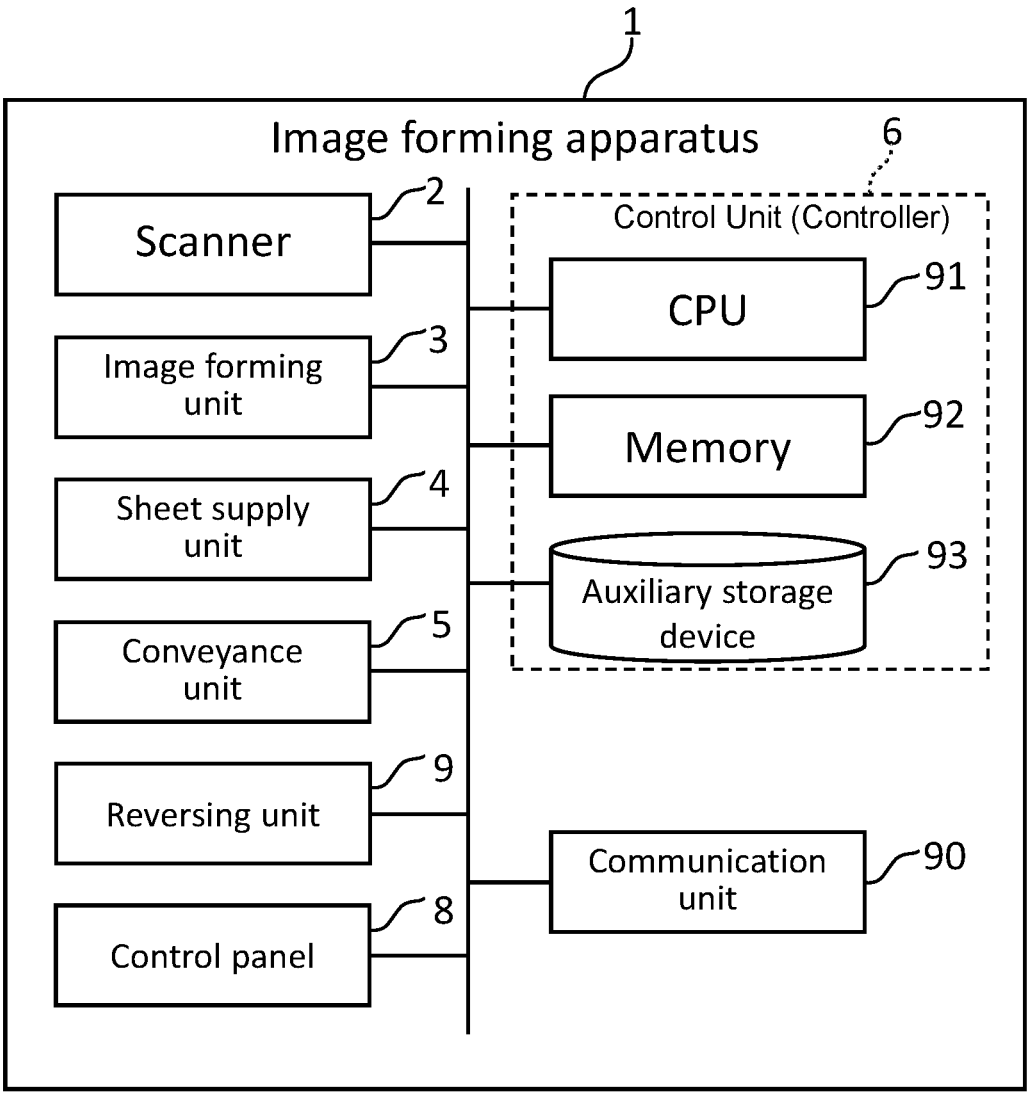
FIG. 2 depicts aspects of a configuration of an image forming apparatus according to an embodiment.

The control unit 6 controls each unit of the image forming apparatus 1. As shown in FIG. 2, the control unit 6 of the image forming apparatus 1 includes a Central Processing Unit (CPU) 91, a memory 92, an auxiliary storage device 93, and the like. The control unit 6 executes a program (or programs). The program(s) when executed by the control unit 6 causes the image forming apparatus 1 to perform or provide the functions of a scanner unit 2, an image forming unit 3, a sheet conveyance unit 4, a conveyance unit 5, a reversing unit 9, a control panel 8, and a communication unit 90.

The CPU 91 of the control unit 6 executes the program stored in the memory 92 and/or the auxiliary storage device 93. The control unit 6 controls each unit of the image forming apparatus 1. The auxiliary storage device 93 stores various programs and data. Examples of the auxiliary storage device 93 include, but are not limited to, a magnetic hard disk device and a semiconductor storage device. The communication unit 90 includes a communication interface or a communication circuit to communicate with an external apparatus or an external device.

Figure 3:
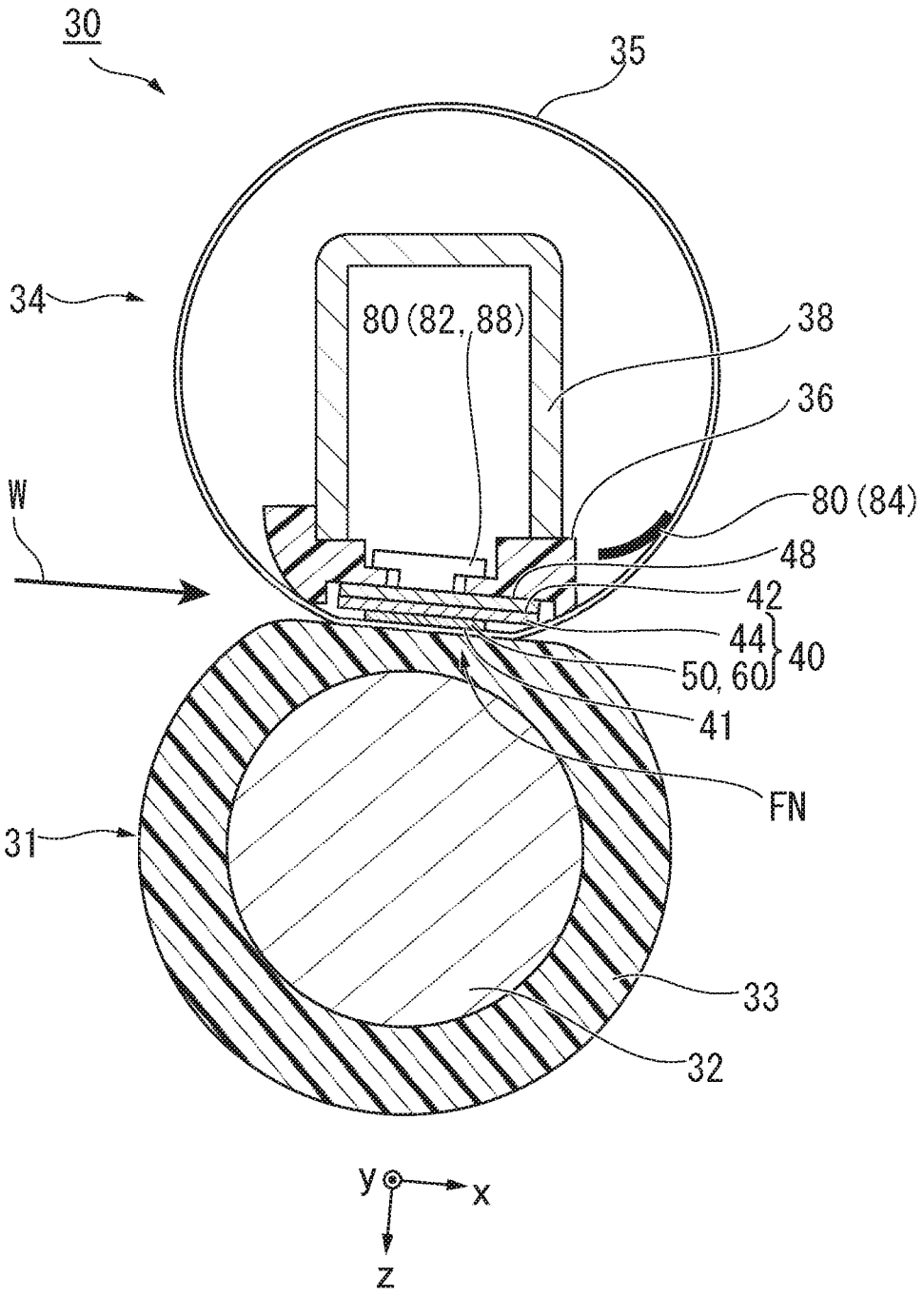
FIG. 3 depicts a fixing device in a cross-sectional view according to an embodiment.

FIG. 3 shows a front cross-section of the fixing device 30 of the image fixing unit 3. The fixing device 30 includes a pressure roller 31 and a heating roller 34. A nip FN is formed between the pressure roller 31 and the heating roller 34.

In the example configuration of the fixing device 30 shown in FIG. 3, z, x and y directions are defined as follows. The z direction is a direction in which the heating roller 34 and the pressure roller 31 are arranged. The +z direction is a direction from the heating roller 34 toward the pressure roller 31. The x direction (or a first direction) is a conveyance direction W of the sheet S through the nip FN, and the +x direction is the downstream side of the conveyance direction W of the sheet S. The y direction (or a second direction) is an axial direction of the heating roller 34. In the example configuration, the heating roller 34 includes a tubular body 35, and the y direction is an axial direction of the tubular body 35.

The pressure roller 31 applies pressure to the toner image on the sheet S at the nip FN. The pressure roller 31 includes a core metal 32 and an elastic layer 33. The configuration of the pressure roller 31 is not limited to the depicted example, and various configurations are possible.

The core metal 32 is formed in a cylindrical shape with a metal material such as stainless steel. The elastic layer 33 is formed of an elastic material such as silicone rubber. The elastic layer 33 has a constant thickness on an outer peripheral surface of the core metal 32. A release layer may be provided on an outer peripheral surface of the elastic layer 33. The release layer may be made of a resin material such as PFA (tetrafluoroethylene-perfluoroalkyl vinyl ether copolymer).

The pressure roller 31 is driven by a motor. When the pressure roller 31 rotates in a state where the nip FN is formed against the tubular body 35 of the heating roller 34, the heating roller 34 is driven to rotate. The pressure roller 31 conveys the sheet S in the conveyance direction W by rotating in a state where the sheet S is present in the nip FN.

The heating roller 34 heats the toner image on the sheet S that has entered the nip FN. The heating roller 34 includes a tubular film 35 (also referred to as a cylindrical body 35), a heat generator unit 40, a heat transfer member 48, a support member 36, a stay 38, and a temperature sensing element 80 (temperature sensor). The configuration of the heating roller 34 is not limited to the depicted example, and various configurations are possible.

The tubular body 35 contacts the sheet S moving in the X direction that is the conveyance direction W to fix the image on the sheet S. The tubular body 35 may be a cylindrical body formed of a thin material or the like. The tubular body 35 of this example is formed of a cylindrical film including a base layer, an elastic layer, and a release layer in this order from the inner circumferential side. The base layer is formed of a material such as nickel (Ni). The elastic layer is formed of an elastic material such as silicone rubber. The release layer is formed of a material such as PFA resin.

The heat generator unit 40 is located inside the interior region surrounded by tubular body 35. The heat generator unit 40 is formed in a rectangular plate shape having a longitudinal or lengthwise direction in the y direction and a lateral or widthwise direction in the x direction. Along the x direction and the y direction, the directions approaching towards the center of the heat generator unit 40 may be referred to as an inner side, and a direction away from the center of the heat generator unit 40 may be referred to as an outer side. A first surface 41 of the heat generator unit 40 on the +z direction side is in contact with the inner surface of the tubular body 35 via a grease or the like.

Figure 4:
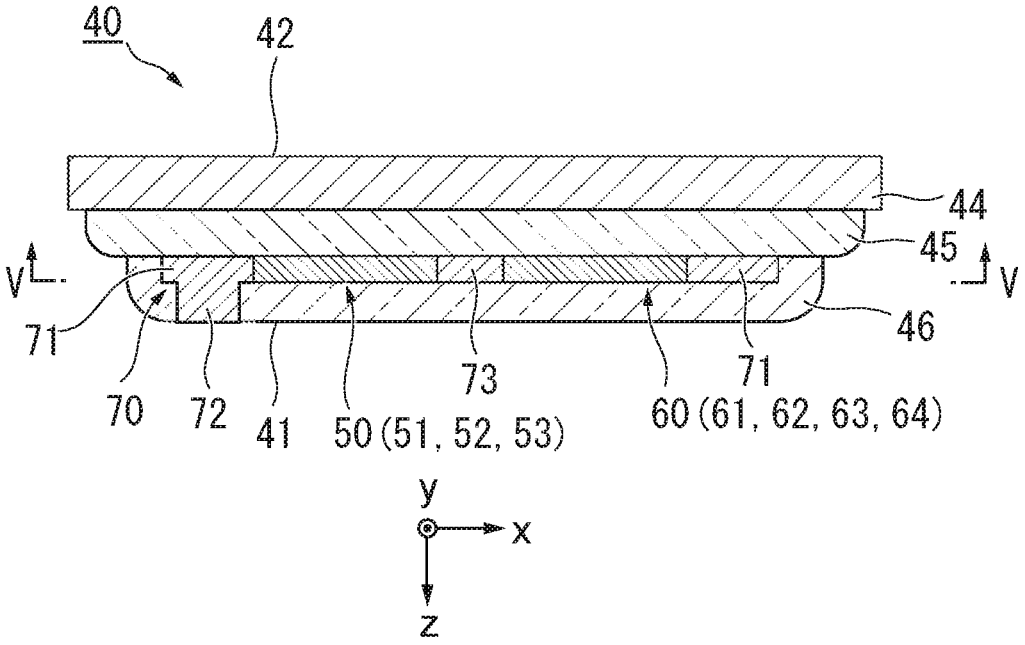
FIG. 4 depicts a heat generator unit in a cross-sectional view according to an embodiment.
Figure 5:
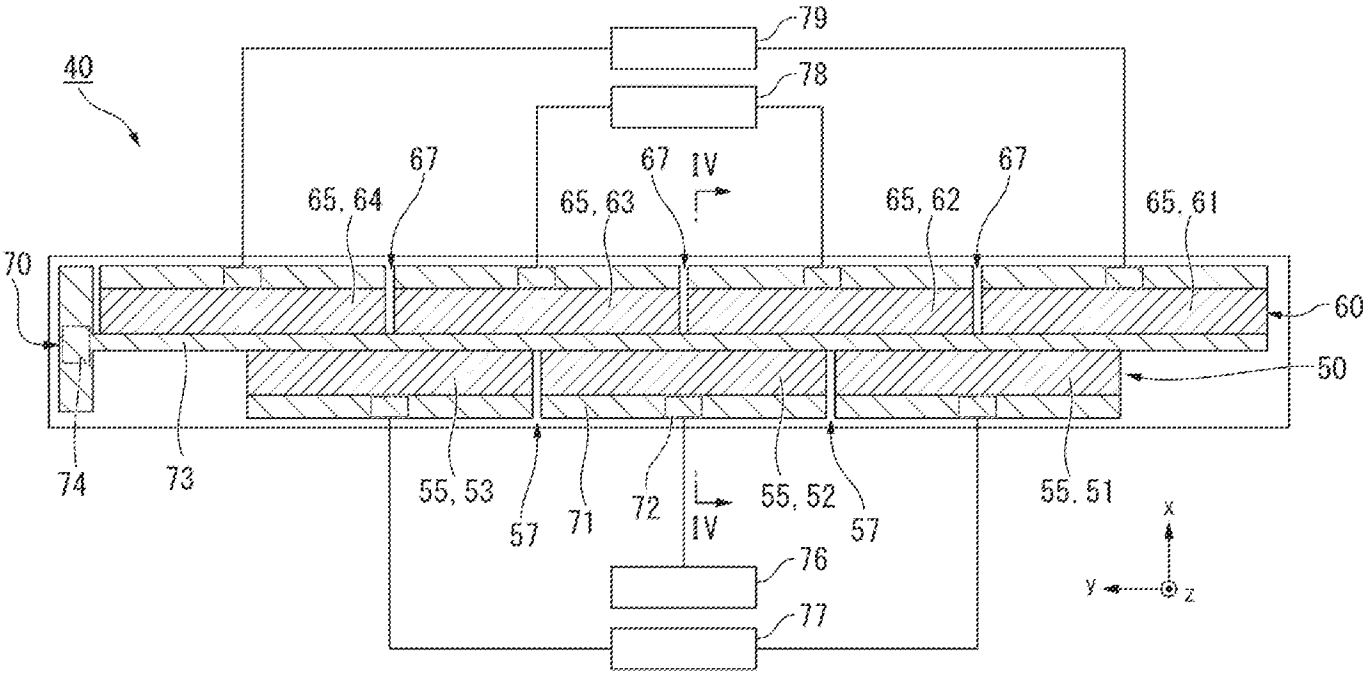
FIG. 5 depicts a heat generator unit in another cross-sectional view according to an embodiment.

FIG. 4 shows a front cross-section of the heat generator unit 40 taken along line IV-IV of FIG. 5. FIG. 5 shows a bottom cross-section of the heat generator unit 40 taken along line V-V of FIG. 4. The heat generator unit 40 includes a substrate 44, a first heat generator set 50, a second heat generator set 60, and a wiring set 70. The first heat generator set 50 and the second heat generator set 60 may be collectively referred to as heat generator sets 50 and 60.

The substrate 44 is formed of a metal material such as stainless steel or a ceramic material such as aluminum nitride. The substrate 44 is formed in a rectangular plate shape having a longitudinal or lengthwise direction in the y direction and a lateral or widthwise direction in the x direction. An insulating layer 45 is formed of a glass material or the like on the +z direction side of the substrate 44. Another insulating layer of a glass material or the like may be formed in the −z direction side of the substrate 44.

The heat generator sets 50 and 60 have heat generator elements formed of, for example, a silver palladium alloy or $TaSiO_2$. The heat generator sets 50 and 60 generate heat by when supplied with electrical power through the wiring set 70. The heat generator sets 50 and 60 and the wiring set 70 are provided on the +z direction side of the insulating layer 45. A protective layer 46 is formed of a glass material or the like so as to cover the heat generator sets 50 and 60 and the wiring set 70. Another protective layer of a glass material or the like may be formed in the −z direction side of the substrate 44.

The heat transfer member 48 (see FIG. 3) has the same outer shape as that of the substrate 44 of the heat generator unit 40. The heat transfer member 48 is arranged in contact with at least a part of or all of a second surface 42 of the heat generator unit 40 on the −z direction side. The heat transfer member 48 is formed of a metal material having high thermal conductivity such as copper.

The support member 36 (see FIG. 3) is formed of a resin material such as a liquid crystal polymer. The support member 36 is disposed so as to cover portions of the −z direction side and both x-direction sides (edges) of the heat generator unit 40. The support member 36 supports the heat generator unit 40 via the heat transfer member 48. Both ends of the support member 36 in the x direction can be rounded or chamfered. The support member 36 supports the inner peripheral surface of the tubular body 35 at both end portions of the heat generator unit 40 in the x direction.

The stay 38 (see FIG. 3) is formed of a steel plate material or the like. The cross section of the stay 38 perpendicular to the y direction is a U shape. The stay 38 is attached to the support member 36 on the −z direction side such that the opening of the U shape is closed by the support member 36. The stay 38 extends along the y direction. Both end portions of the stay 38 in the y direction can be fixed to the housing 10 of the image forming apparatus 1 or the like.

The temperature sensing element 80 (see FIG. 3) includes a heater thermometer 82, a thermostat 88, and a film thermometer 84. The heater thermometer 82 and the thermostat 88 are located on the −z direction side of the heat generator unit 40 with the heat transfer member 48 interposed therebetween. The heater thermometer 82 measures temperature of the heat generator unit 40 via the heat transfer member 48. When the temperature of the heat generator unit 40 (as detected via the heat transfer member 48) exceeds a predetermined temperature, the thermostat 88 cuts off power to the heat generator sets 50 and 60. The film thermometer 84 is in contact with the inner circumferential surface of the tubular body 35 and measures temperature of the tubular body 35.

As shown in FIG. 5, the first heat generator set 50 and the second heat generator set 60 each extend along the y direction (the axial direction of the tubular body 35 of the heating roller 34) and are arranged side by side along the x direction (the conveyance direction W of the sheet S). The first and second heat generators 50 and 60 are arranged in the −x and +x directions, respectively.

The first heat generator set 50 includes a plurality of first heat generator elements 55 (51, 52, 53). Each of the first heat generator elements 55 is formed in a rectangular shape having longitudinal (lengthwise) and lateral (widthwise) directions parallel to the y and x directions, respectively. For example, each first heat generator elements 55 has the same dimensions as the others in y direction and x direction. The plurality of first heat generator elements 55 are arranged side by side along the y direction. A first non-heating region 57 (a gap) is left between the adjacent first heat generator elements 55. That is, no heat generator element or heat generating portion thereof is provided in the first non-heating region 57. The first heat generator elements 55 are alternately arranged with the first non-heating regions 57 along the y direction.

The second heat generator set 60 includes a plurality of second heat generator elements 65 (61, 62, 63, 64). Each second heat generator element 65 is formed in a rectangular shape having longitudinal (lengthwise) and lateral (widthwise) directions parallel to the y and x directions, respectively. For example, the dimensions of each of the second heat generator elements 65 in the y direction are the same. Similarly, the dimensions of each of the second heat generators 65 in the x direction are the same as one another. The second heat generator elements 65 are arranged side by side along the y direction. A second non-heating region 67 (a gap) is left between the adjacent second heat generator elements 65. The plurality of second heat generator elements 65 are alternate with the second non-heating regions 67 along the y direction.

The length of each first heat generator element 55 can be equal to the lengths of each of the second heat generator elements 65 in the y direction. Likewise, the width of each first heat generator element 55 can be equal to the widths of each of the second heat generator elements 65 in the x direction. The first non-heat generating region 57 and the second non-heat generating region 67 have the same dimension (gap width) in the y direction, for example. However, the dimension of the first non-heating region 57 in the y direction is significantly less than the length of the second heat generator element 65 in the y direction. Likewise, the dimension (gap width) of the second non-heating region 67 in the y direction is significantly less than the length of the first heat generator element 55 in the y direction.

The wiring set 70 includes individual electrodes 71, individual terminals 72, a common electrode 73, and a common terminal 74. The individual electrodes 71 are individually arranged with respect to the corresponding first and second heat generator elements 55 and 65. The individual electrodes 71 are positioned outside the first and second heat generator elements 55 and 65 in the x direction. Each individual electrode 71 of each first heat generator element 55 is formed along an end side or an outer edge of the first heat generator element 55 in the −x direction and is connected to the first heat generator element 55. Each individual electrode 71 of each second heat generator element 65 is formed along an end side or an outer edge of the second heat generator element 65 in the +x direction and is connected to the second heat generator element 65.

Figure 6:
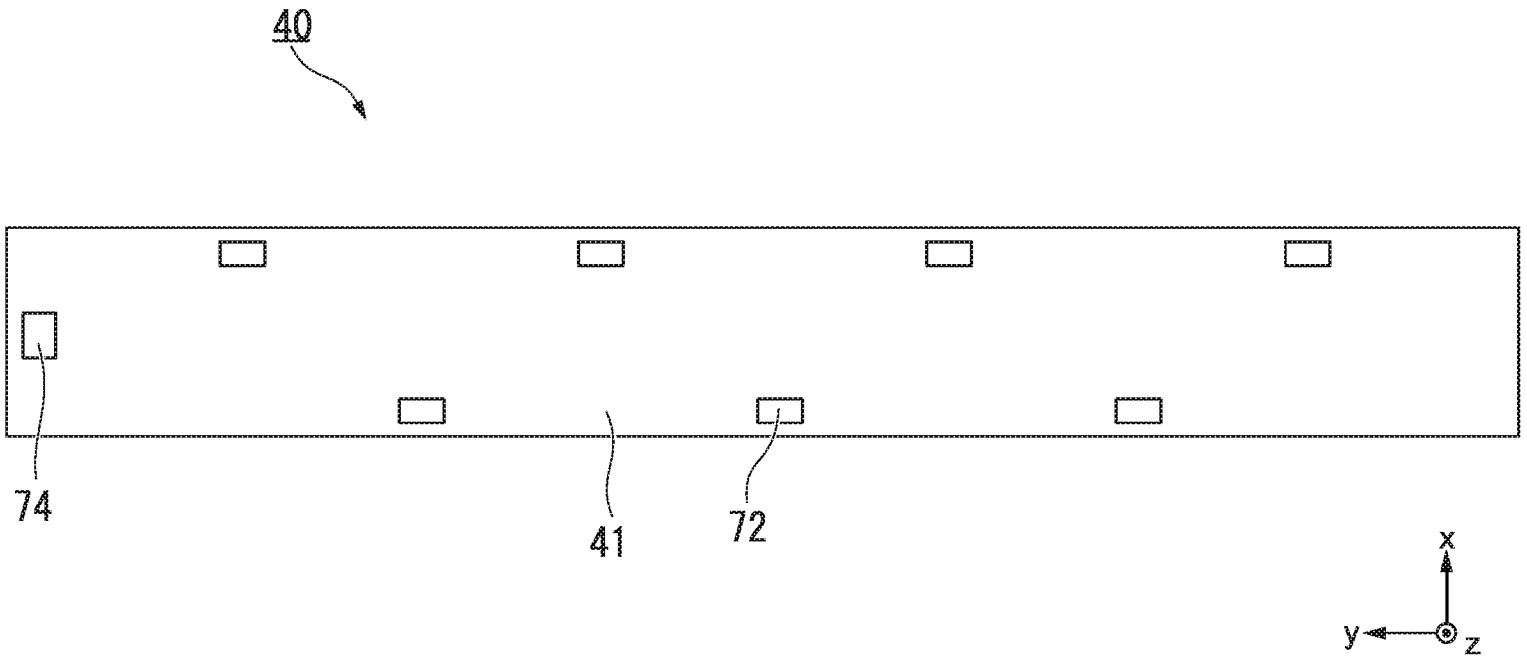
FIG. 6 is a bottom view of a heat generator unit according to an embodiment.

Each individual terminal 72 is provided at the center of each individual electrode 71 in the y direction. As shown in FIG. 4, the individual terminal 72 extends from the individual electrode 71 in the +z direction. A +z direction end portion of the individual terminal 72 is exposed at the first surface 41 of the heat generator unit 40. FIG. 6 shows a bottom plane of the heat generator unit 40 viewed from the +z direction towards the −z direction. The individual terminals 72 are arranged corresponding to the plurality of individual electrodes 71. The individual terminals 72 are exposed at the first surface 41 of the heat generator unit 40.

As shown in FIG. 5, the common electrode 73 is connected in common to the plurality of first heat generator elements 55 and the plurality of second heat generator elements 65. The common electrode 73 linearly extends along the y direction. The common electrode 73 is between the first heat generator elements 55 and the second heat generator elements 65 in the x direction. The common electrode 73 is connected to the +x direction end of the first heat generator elements 55 and the −x direction end of the second heat generator elements 65. The common terminal 74 extends along the +z direction from a +y direction end portion of the common electrode 73. As shown in FIG. 6, a +z direction end portion of the common terminal 74 is exposed to the first surface 41 of the heat generator unit 40. The common terminal 74 is connected to a power supply.

As shown in FIG. 5, the individual terminals 72 are connected to a power supply via a plurality of triacs (triacs 76, 77, 78, 79). The power supply may be the same as or different from that of the common terminal 74. The control unit 6 (see FIG. 2) controls ON/OFF of the triacs 76 to 79 independently of each other. Thus, the first heat generator set 50 and the second heat generator set 60 can generate heat independently of each other.

Among the plurality of first heat generator elements 55, the first heat generator element 55 at the center along the y direction is referred to as a center heat generator element 52. The center heat generator element 52 is connected to the first triac 76. Among the plurality of first heat generator elements 55, the first heat generator elements 55 at both y direction ends are referred to as end heat generator elements 51 and 53, respectively. The end heat generator elements 51 and 53 are connected to the second triac 77. The control unit 6 controls ON/OFF of the first triac 76 and the second triac 77 independently of each other. Thus, the center heat generator element 52 and the end heat generator elements 51 and 53 can generate heat independently of each other. The pair of end heat generator elements 51 and 53 similarly generate heat.

Among the plurality of second heat generator elements 65, the second heat generator elements 65 in the middle along the y direction are middle heat generator elements 62 and 63. The middle heater elements 62 and 63 are connected to the third triac 78. Among the plurality of second heat generator elements 65, the second heat generator elements 65 at both y direction ends are end heat generator elements 61 and 64, respectively. The end heat generator elements 61 and 64 are connected to the fourth triac 79. The control unit 6 controls ON/OFF of the third triac 78 and the fourth triac 79 independently of each other. Thus, the middle heat generator elements 62 and 63 and the end heat generator elements 61 and 64 can generate heat independently of each other. The pair of middle heat generator elements 62 and 63 similarly generate heat as one another. The pair of end heat generator elements 61 and 64 similarly generate heat as one another.

In the image forming apparatus 1, the sheets S can have various sizes. Each sheet S is conveyed along the x direction with the center of the sheet S in the y direction being aligned with the center of the fixing device 30 in the y direction.

The control unit 6 causes the heat generator sets 50 and 60 to generate heat so that the temperature of the tubular body 35 in the region (referred to in this context as the first region) through which the sheet S passes reaches a predetermined fixing temperature. In the first region through which the sheet S passes, the sheet S takes heat from the tubular body 35. In the region (referred to in this context as the second region) through which the sheet S does not pass, the temperatures of the tubular body 35 and the heat generator unit 40 both increase. When a large number of sheets S pass through the fixing device 30 per unit time, the amount of heat generated by the heat generator sets 50 and 60 must increase to compensate for heat withdrawn by the sheets S. In the second region through which the sheet S does not pass, the temperature increase of the tubular body 35 and the heat generator unit 40 becomes large.

When a sheet S has a relatively large width in the y direction, the control unit 6 causes the entire first heat generator set 50 (that is, the first heat generator elements 51, 52, 53) and the entire second heat generator set 60 (that is, the second heat generator elements 61, 62, 63, 64) to generate heat. On the other hand, when the sheet S has a relatively small width in the y direction, the control unit 6 causes only the center heat generator element 52 of the first heat generator set 50 and the middle heat generator elements 62 and 63 of the second heat generator set 60 to generate heat. Since the first heat generator set 50 may include three or more first heat generator elements 55, it is possible to cause only the center heat generator element 52 to generate heat. The same applies to the second heat generator set 60.

As described above, when a sheet S having a small width in the y direction is being processed, the control unit 6 causes only the center heat generator element 52 and the middle heat generator elements 62 and 63 generate heat. Accordingly, in the second region, that is a y direction end portion through which the sheet S does not pass, the excessive temperature increase of the tubular body 35 and the heat generator unit 40 is avoided. This prevents or mitigates the increase in temperature of the support member 36 that supports the heat generator unit 40 via the heat transfer member 48. The temperature of the support member 36, which is formed of resin material, can be kept equal to or lower than its heat resistance temperature. Furthermore, a malfunction or a failure of the tubular body 35 and the temperature sensing element 80 due to an undesirable temperature increase can be avoided.

In the first heat generator set 50 shown in FIG. 5, the first heat generator elements 55 generate heat, but the first non-heating regions 57 do not generate heat. As a result, an uneven temperature distribution (temperature unevenness) occurs along the y direction of the first heat generator set 50. Accordingly, temperature unevenness occurs also along the y direction of the tubular body 35 and the sheet S. As a result, gloss unevenness may occur in an image fixed on the sheet S. The same applies to the second heat generator set 60.

The first non-heating regions 57 of the first heat generator set 50 and the second non-heating regions 67 of the second heat generator set 60 are at different positions along the y direction. The first non-heat generating regions 57 and the second non-heat generating regions 67 are disposed so as to not be adjacent to each other in the x direction. The second heat generator elements 65 are shifted in the +x direction from the first non-heating regions 57, and the first heat generator elements 55 are shifted in the −x direction from the second non-heating regions 67. The entire heat generator sets 50 and 60 in the y direction can generate heat. This suppresses temperature unevenness of the fixing device 30.

Along the y direction of the first heat generator set 50, the center of a first non-heating region 57 has the lowest temperature, and the center of a first heat generator element 55 has the highest temperature. Along the y direction of the second heat generator set 60, the center of a second non-heating region 67 has the lowest temperature, and the center of a second heat generator element 65 has the highest temperature.

The y-direction center of a first non-heating region 57 and the y-direction center of a second heat generator element 65 are at the same position or aligned with each other. The y-direction center of the first non-heating region 57 and the y-direction center of the second heat generator element 65 are arranged to be adjacent to each other in the x direction. Similarly, the y-direction center of the second non-heating region 67 and the y-direction center of the first heat generator element 55 are at the same position or aligned with each other. The y-direction center of the second non-heating region 67 and the y-direction center of the first heat generator element 55 are arranged adjacent to each other in the x direction. Thus, the temperatures of the heat generator sets 50 and 60 are equalized along the y direction. Temperature unevenness of the fixing device 30 is suppressed.

A y-direction end portion of the second heat generator set 60 is located beyond a y-direction end portion of the first heat generator set 50. At the end portions of the heat generator sets 50 and 60 in the y direction, only the second heat generator set 60 (or more specifically the end heat generator elements 61 and 64) can generate heat. Accordingly, in the region of the y-direction end portions through which the sheet S does not pass, an undesired increase in temperature of the tubular body 35, the heat generator unit 40, the heat transfer member 48, the support member 36, and the like is avoided. In another embodiment, the y-direction end portions of the first heat generator set 50 may be located beyond the y-direction end portions of the second heat generator set 60.

The first heat generator set 50 includes the center heat generator element 52 at the center in the y direction and the end heat generator elements 51 and 53 at the ends in the y direction. The center heat generator element 52 and the end heat generator elements 51 and 53 can generate heat independently of each other. Similarly, the second heat generator set 60 includes the middle heat generator elements 62 and 63 at the center in the y direction and the end heat generator elements 61 and 64 at the ends in the y direction. The middle heat generator elements 62 and 63 and the end heat generator elements 61 and 64 can generate heat independently of each other.

In the case of the sheet S having a smaller width in the y direction, only the center heat generator element 52 of the first heat generator set 50 and the central middle heat generator elements 62 and 63 of the second heat generator set 60 generate heat. Accordingly, in the region of the y-direction end portions through which the sheet S does not pass, the temperature increase of the tubular film 35, the heat generator unit 40, the heat transfer member 48, the support member 36, and the like can be avoided.

The image forming apparatus 1 according to the present embodiment includes the image forming unit 3, the fixing device 30, the tubular body 35, the element unit 40, the first and second heat generator sets 50 and 60, the plurality of first and second heat generator elements 55 and 65. The image forming unit 3 forms an image on the sheet S. The fixing device 30 fixes the image on the sheet S. The tubular body 35 is included in the fixing device 30 and may have a film shape. The heat generator unit 40 is included in the fixing device 30 and contacts the inner surface of the tubular body 35 at the first surface 41 whose longitudinal direction aligns with the y direction. The first heat generator set 50 and the second heat generator set 60 are included in the heat generator unit 40 and are arranged adjacent to one another in the x direction. The first heat generator set 50 and the second heat generator set 60 can be controlled to generate heat independently of each other. A plurality of first heat generator elements 55 is included in the first heat generator set 50 and these are arranged alternately with the first non-heating regions 57 along the y direction. A plurality of second heat generator elements 65 is included in the second heat generator set 60 and these are arranged alternately with the second non-heating regions 67 along the y direction. The second non-heat generating regions 67 are disposed at non-overlapping positions with respect to the first non-heat generating regions 57. Thus, temperature unevenness along the y direction of the fixing device 30 is suppressed when both heat generator sets 50 and 60 are used together for heating.

Figure 7:
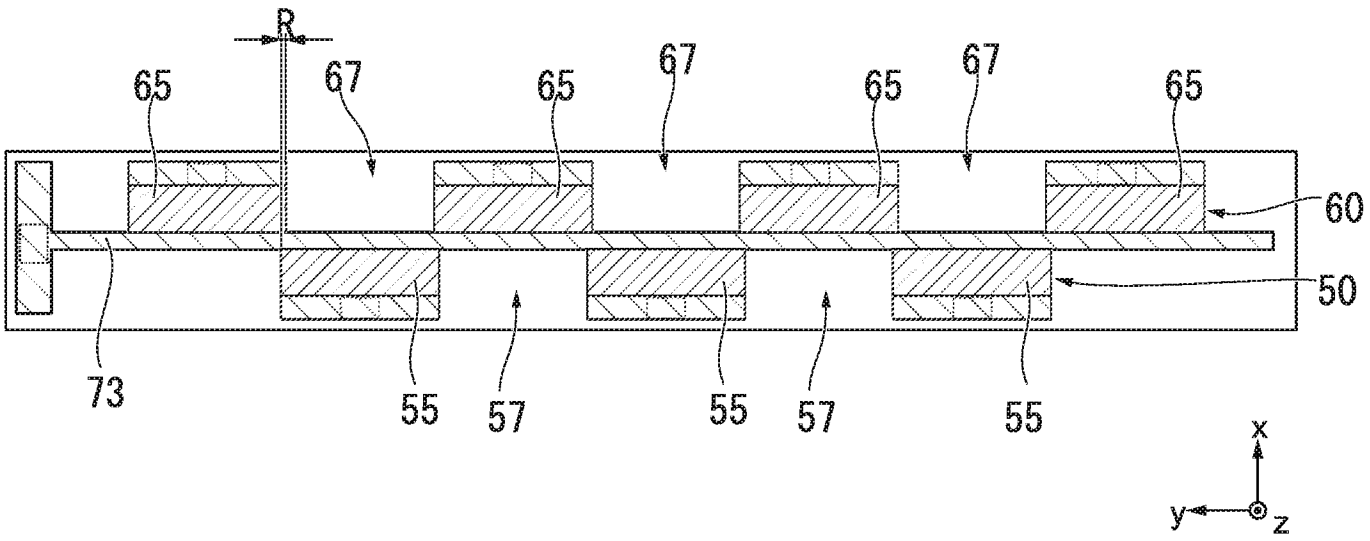
FIG. 7 depicts a heat generator unit in a cross-sectional view according to a modified embodiment.

FIG. 7 shows a bottom cross-section of a heat generator unit of a modified embodiment in a portion corresponding to the V-V line of FIG. 4. In the modified embodiment shown in FIG. 7, the lengths of the first heat generator element 55 and the second heat generator element 65 in the y direction are less than those of the embodiment shown in FIG. 5. The length of each of the first heat generator elements 55 in the y direction may be the same as or different from that of each of the second heat generator elements 65. The length of each of the first non-heat generating regions 57 in the y direction may be the same as or different from that of each of the second non-heat generating regions 67. For example, the length of each of the first non-heating regions 57 in the y direction can be made slightly shorter than that of each of the second heat generator elements 65. Alternatively, for example, the length of each of the second non-heating regions 67 in the y direction can be made slightly shorter than that of each of the first heat generator elements 55.

A y-direction end portion of each first heat generator element 55 is adjacent in the x direction to a y-direction end portion of a second heat generator element 65 in with the common electrode 73 arranged therebetween. An end portion of the first heat generator element 55 and an end portion of the second heat generator element 65 in the y direction overlap each other in the x direction. The region in which an end portion of a first heat generator element 55 and an end portion of a second heat generator element 65 overlap with each other in the x direction is referred to as a region R as shown in FIG. 7. The y direction length of the region R (amount of overlap) is selected such that the temperature of the region R does not become excessively higher than the temperature of the other regions. For example, the length of the region R in the y direction is less than the dimension (width) of a first heat generator element 55 or a second heat generator element 65 in the x direction. The length of the region R in the y direction may be less than the dimension (width) of the common electrode 73 in the x direction.

In the region where the first heat generator elements 55 are provided, the center part along the y direction has the highest temperature, and the end part in the y direction has the lowest temperature. The same applies to the region where the second heat generator elements 65 are provided. Since the end portion of each of the first heat generator elements 55 and the end portion of each of the second heat generator elements 65 in the y direction are arranged to be adjacent to each other in the x direction, the temperatures of the heat generator sets 50 and are equalized along the y direction. This suppresses temperature unevenness in the fixing device 30.

The heat generator unit 40 of an embodiment includes two rows of heat generator sets, that is, the first heat generator set 50 and the second heat generator set 60. In another embodiment, the heat generator unit 40 may include three or more rows of heat generator sets.

The first heat generator set 50 of an embodiment has three first heat generator elements 55, and the second heat generator set 60 has four second heat generator elements 65. In another embodiment, the first heat generator set 50 may include four or more first heat generator elements 55, and the second heat generator set 60 may include three second heat generator elements 65 or five or more second heat generator elements 65.

The image forming apparatus 1 of an embodiment is one type of image processing apparatus, and the fixing device 30 is one type of heating device. In another embodiment, the image processing apparatus may be a decoloring device, and the heating device may be a decoloring unit. A decoloring device performs a process of decoloring (or erasing) an image formed on a sheet with a decoloring toner. The decoloring unit heats and decolors the decoloring toner image formed on the sheet passing through a nip.

According to at least one embodiment, each of the second non-heat generating regions 67 is arranged at a position along the y direction different from the first non-heat generating regions 57. This suppresses temperature unevenness in the fixing device 30.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming unit configured to form an image on a sheet;

a fixing device configured to heat the sheet, the fixing device including:

a tubular body configured to press against the sheet and rotate in a sheet conveyance direction; and a heat generator having a first side contacting an inner surface of the tubular body, a longitudinal direction of the heat generator being aligned with an axial direction of the tubular body, wherein the heat generator includes:

a substrate;

an insulating layer on the substrate;

a plurality of first heating elements in a first row along the longitudinal direction on the insulating layer, a first gap being between each adjacent pair of first heating elements in the longitudinal direction;

a plurality of second heating elements in a second row along the longitudinal direction on the insulating layer, the first and second rows being offset from one another in a width direction corresponding to the sheet conveyance direction, a second gap being between each adjacent pair of second heating elements in the longitudinal direction; and a protective layer covering the plurality of first heating elements, the plurality of second heating elements, and the insulating layer, positions of the first gaps along the longitudinal direction are different from positions of the second gaps along the longitudinal direction, and the insulating layer is between the plurality of first heating elements and the substrate and between the plurality of second heating elements and the substrate.

2. The image forming apparatus according to claim 1, wherein the protective layer is on the first side of the heat generator, and the heat generator has a second side which is opposite the first side.

3. The image forming apparatus according to claim 2, further comprising:

a heat transfer member contacting the second side of the heat generator.

4. The image forming apparatus according to claim 1, wherein the tubular body contacts the protective layer.

5. The image forming apparatus according to claim 1, wherein a center of each first gap is aligned along the width direction with a center of one of the second heating elements.

6. The image forming apparatus according to claim 5, wherein a center of each second gap is aligned along the width direction with a center of one of the first heating elements.

7. The image forming apparatus according to claim 1, wherein a center of each second gap is aligned along the width direction with a center of one of the first heating elements.

8. The image forming apparatus according to claim 1, wherein each the first heating elements has a longitudinal end portion aligned with a longitudinal end portion of one of the second heating elements along the width direction.

9. The image forming apparatus according to claim 1, wherein the second row extends in the longitudinal direction beyond an end of the first row.

10. The image forming apparatus according to claim 9, wherein at least one second heating element has a portion at position along the longitudinal direction that is beyond an outermost end of the first heating elements in the first row.

11. The image forming apparatus according to claim 1, wherein each of the first heating elements is independently controllable.

12. The image forming apparatus according to claim 1, wherein the plurality of first heating elements includes a central element at a center of the first row along the longitudinal direction and an end element at an outermost end of the first row in the longitudinal direction.

13. The image forming apparatus according to claim 1, wherein the plurality of second heating elements includes a central element at a center of the second row along the longitudinal direction and an end element at an outermost end of the second row in the longitudinal direction.

14. The image forming apparatus according to claim 1, wherein the plurality of first heating elements and the plurality of second heating elements are independently controllable.

15. A sheet processing apparatus, comprising:

a sheet conveyor configured to convey a sheet for processing; and a heating device configured to heat the sheet conveyed by the sheet conveyor, the heating device comprising:

a cylindrical body configured to contact the sheet while the sheet is being moved past the cylindrical body in a sheet conveyance direction;

an insulating layer on a first side of a heater substrate;

a plurality of first heat generator elements in a first row along a first direction on the insulating layer, the first heat generator elements being separated from one another in the first direction by a first gap;

a plurality of second heat generator elements in a second row spaced from the first row in a second direction intersecting the first direction on the insulating layer, the second heat generator elements being separated from one another in the first direction by a second gap; and a protective layer covering the plurality of first heat generator elements, the plurality of second heat generator elements, and the insulating layer on the first side of the heater substrate, wherein a center of each first gap is aligned to a center of one of the second heat generator elements; and a center of each of the second gap is aligned to a center of one of the first heat generator elements.

16. The sheet processing apparatus according to claim 15, wherein the protective layer contacts the cylindrical body, and the heating device further comprises a heat transfer member on a second side of the heater substrate opposite of the first side.

17. The sheet processing apparatus according to claim 15, wherein the width of each first gap in the first direction is less than the length of the first heat generator elements in the first direction.

18. A fixing device, comprising:

a pressure roller; and a heating roller configured to contact the pressure roller and apply heat to a sheet passing between the heating roller and the pressure roller in a sheet conveyance direction, the heating roller comprising:

a heater substrate with a first side;

an insulating layer on the first side of the heater substrate;

a first row of first heat generator elements on the insulating layer along a first direction perpendicular to the sheet conveyance direction;

a second row of second heat generator elements on the insulating layer along the first direction, the second row being spaced from the first row in a second direction crossing the first direction;

a plurality of first gaps between adjacent first heat generator elements in the first row; and a plurality of second gaps between adjacent second heat generator elements in the second row;

a protective layer on the first side of the heater substrate covering the first heat generator elements, the second heat generator elements, and the insulating layer, wherein the insulating layer is between the first generator elements and the heater substrate, the insulating layer is between the second generator elements and the heater substrate, the first gaps are at positions that do not overlap with the second gaps along the second direction, and the first and second heat generator elements are wired for independent control.

19. The fixing device according to claim 18, wherein the second row extends beyond the ends of the first rows in the first direction.

20. The fixing device according to claim 18, further comprising:

a heat transfer member on a second side of the heater substrate, the second side being opposite the first side.

* * * * *